US012022958B2

(12) United States Patent
Zhang

(10) Patent No.: US 12,022,958 B2
(45) Date of Patent: Jul. 2, 2024

(54) FOLDING CHAIR FRAME STRUCTURE

(71) Applicant: Fujian Sunwee Outdoor Co., Ltd., Fujian (CN)

(72) Inventor: Dexing Zhang, Longyan (CN)

( * ) Notice: Subject to any disclaimer, the term of this patent is extended or adjusted under 35 U.S.C. 154(b) by 98 days.

(21) Appl. No.: 17/978,220

(22) Filed: Nov. 1, 2022

(65) Prior Publication Data

US 2024/0008649 A1 Jan. 11, 2024

(30) Foreign Application Priority Data

Jul. 6, 2022 (CN) ..... 202221747472.X

(51) Int. Cl.
*A47C 4/28* (2006.01)

(52) U.S. Cl.
CPC ..... *A47C 4/28* (2013.01); *A47C 4/283* (2013.01); *A47C 4/286* (2013.01)

(58) Field of Classification Search
CPC ..... A47C 4/283; A47C 4/286
USPC ..... 297/45
See application file for complete search history.

(56) References Cited

U.S. PATENT DOCUMENTS 6,082,813 A * 7/2000 Chen ..... A47C 4/286 297/45 X
6,634,705 B1 * 10/2003 Zheng ..... A47C 4/286 297/45 X
6,840,574 B1 * 1/2005 Wu ..... A47C 1/0265 297/45 X
6,926,356 B2 * 8/2005 Chen ..... A47C 4/286 297/45 X
7,017,985 B2 * 3/2006 Chen ..... A47C 4/286 297/45 X
8,100,469 B2 * 1/2012 Lougee ..... A47C 4/44 297/58
8,511,747 B2 * 8/2013 Lougee ..... A47C 9/105 297/16.2
8,864,222 B2 * 10/2014 Grace ..... A47C 1/0265 297/44 X
9,204,729 B2 * 12/2015 Frankel ..... A47C 1/14
9,622,583 B1 * 4/2017 Lv ..... A47C 4/286
10,206,510 B2 * 2/2019 Choi ..... A47C 4/286
10,278,506 B2 * 5/2019 Yang ..... A47C 4/283
(Continued)

FOREIGN PATENT DOCUMENTS

CN 203828452 U * 9/2014 ..... A47C 4/286
CN 104873021 A * 9/2015 ..... A47C 4/286
(Continued)

*Primary Examiner* — Rodney B White

(57) ABSTRACT

A folding chair frame structure includes left and right supporting frame units, front and rear connecting frame units, and a pair of armrest supporting rods. A top of each armrest supporting rod has a spherical head. Each armrest supporting rod has an engaging groove below the spherical head. A pair of armrest rods is pivotally connected to respective rear parts of the left and right supporting frame units. A front end of each armrest rod has a joint. A lower end of the joint has an accommodating chamber. A side wall of the accommodating chamber has at least one receiving opening. An engaging plate is detachably inserted in the receiving opening. The engaging plate has a through hole. When the spherical head is inserted in the accommodating chamber and passes through the through hole, the engaging plate is engaged with the engaging groove.

10 Claims, 7 Drawing Sheets

(56) References Cited

U.S. PATENT DOCUMENTS

| | | | | |
|---|---|---|---|---|
| 10,631,648 | B1 * | 4/2020 | Tsai | A47C 4/286 |
| 10,722,034 | B2 * | 7/2020 | Winterhalter | A47C 4/286 |
| 10,758,048 | B1 * | 9/2020 | Tsai | A47C 3/00 |
| 10,842,279 | B2 * | 11/2020 | Chen | A47C 4/30 |
| 10,874,217 | B2 * | 12/2020 | Grace | A47C 4/286 |
| 11,006,755 | B2 * | 5/2021 | Yang | A47C 4/00 |
| 11,096,493 | B1 * | 8/2021 | Tsai | A47C 4/286 |
| 2023/0036948 | A1 * | 2/2023 | Choi | A47C 3/02 |
| 2023/0232984 | A1 * | 7/2023 | Frankel | A47C 4/286<br>297/38 |

FOREIGN PATENT DOCUMENTS

| | | | | | |
|---|---|---|---|---|---|
| JP | 2005118214 | A | * | 5/2005 | A47C 4/286 |
| KR | 20140124038 | A | * | 10/2014 | A47C 4/286 |
| KR | 101453405 | B1 | * | 12/2014 | |
| KR | 101464186 | B1 | * | 12/2014 | A47C 4/286 |
| KR | 101466721 | B1 | * | 12/2014 | A47C 4/286 |

* cited by examiner

FOLDING CHAIR FRAME STRUCTURE

BACKGROUND OF THE INVENTION

1. Field of the Invention

The present invention relates to furniture, and more particularly to a folding chair frame structure.

2. Description of the Prior Art

In order to move a chair with ease and save the space occupied by the chair, a folding chair has been developed. Folding chairs have been widely used in our daily life and in an office environment.

A folding chair usually includes a foldable chair frame and a seat mounted to the chair frame. In general, a pair of armrests is fixedly connected to the chair frame. When the folding chair is to be folded or unfolded, the armrests are immovable. The armrests are only pivoted up or down along with the support legs of the chair frame. When the folding chair is unfolded for use, it is troublesome for a fat person to seat himself/herself in the folding chair because of the restricted distance between the armrests. In a conventional folding chair, armrests are pivotally connected to corresponding rods of the chair frame. When the folding chair is unfolded for use, the stability of the folding chair is poor. The folding chair may be folded wrongly, and the armrests cannot be folded to be against the back rods of the chair frame. As a result, the folding chair is still large in size after being folded.

SUMMARY OF THE INVENTION

The primary object of the present invention is to provide a folding chair frame structure, which can be used conveniently, is small in size after being folded, and has better stability. It is easy for a fat person to seat himself/herself in the folding chair.

In order to achieve the above object, the present invention adopts the following technical solutions.

A folding chair frame structure comprises a left supporting frame unit, a right supporting frame unit, a front connecting frame unit, and a rear connecting frame unit. The front connecting frame unit is pivotally connected between a front part of the left supporting frame unit and a front part of the right supporting frame unit. The rear connecting frame unit is pivotally connected between a rear part of the left supporting frame unit and a rear part of the right supporting frame unit. A pair of armrest supporting rods is pivotally connected between an upper left end of the front connecting frame unit and the front part of the left supporting frame unit and between an upper right end of the front connecting frame unit and the front part of the right supporting frame unit, respectively. A top of each armrest supporting rod has a spherical head. Each armrest supporting rod has an engaging groove below the spherical head. A pair of armrest rods is pivotally connected to a rear part of the left supporting frame unit and a rear part of the right supporting frame unit. A front end of each armrest rod has a joint. A lower end of the joint has an accommodating chamber. A side wall of the accommodating chamber has at least one receiving opening. An engaging plate is detachably inserted in the receiving opening. The engaging plate has a through hole. When the spherical head is inserted in the accommodating chamber and passes through the through hole, the engaging plate is engaged with the engaging groove.

Preferably, the engaging plate includes a vertical plate and a horizontal plate. The vertical plate is vertically arranged at one end of the horizontal plate. The horizontal plate has the through hole. When the horizontal plate is inserted in the receiving opening and the spherical head passes through the through hole, the horizontal plate is engaged with the engaging groove.

Preferably, an outer side wall of the accommodating chamber is recessed to form a plate groove located above the receiving opening. A surface of the plate groove, facing the vertical plate, has a positioning post. A surface of the vertical plate, facing the plate groove, is recessed to form an accommodating hole. A spring is sleeved on the positioning post. One end of the spring is accommodated in the accommodating hole. The vertical plate is disposed in the plate groove. When the vertical plate is pressed, the spring is compressed, so that the through hole is aligned with the spherical head for the spherical head to pass through the through hole.

Preferably, the horizontal plate is formed with a waist-shaped hole. A locking member is insertedly secured to the lower end of the joint. The locking member passes through the waist-shaped hole.

Preferably, a mating plate is vertically protruded from the surface of the vertical plate, facing the plate groove. The mating plate is located above the accommodating hole. The plate groove is formed with a mating plate opening. The mating plate is movably inserted in the mating plate opening.

Preferably, the at least one receiving opening includes two receiving openings. The receiving openings are disposed opposite to each other. The horizontal plate is connected between the receiving openings.

Preferably, the through hole has a front curved hole edge and a rear flat hole edge.

Preferably, a cup holder is pivotally connected to at least one of the pair of armrest supporting rods. A pair of slide sleeves is connected to respective bottoms of the armrest supporting rods. The slide sleeves are sleeved on the front part of the left supporting frame unit and the front part of the right supporting frame unit, respectively. A pair of restricting members is disposed on a lower end of the front part of the left supporting frame unit and a lower end of the front part of the right supporting frame unit. The slide sleeves are located above the restricting members and are slidable.

Preferably, an upper end of each armrest supporting rod has a bent portion that is bent outward.

Preferably, the left supporting frame unit includes a left back rod, a left diagonal strut, and a left connecting rod. A top of the left diagonal strut is pivotally connected to the left back rod. The left connecting rod is pivotally connected among the left back rod, the left diagonal strut and an adjacent one of the pair of armrest supporting rods. The right supporting frame unit includes a right back rod, a right diagonal strut, and a right connecting rod. A top of the right diagonal strut is pivotally connected to the right back rod. The right connecting rod is pivotally connected among the right back rod, the right diagonal strut and an adjacent one of the pair of armrest supporting rods. The front connecting frame unit includes a front first connecting rod and a front second connecting rod that are intersected with each other. Middle portions of the front first connecting rod and the front second connecting rod are pivotally connected to each other. The rear connecting frame unit includes a rear first connecting rod and a rear second connecting rod that are intersected with each other. Middle portions of the rear first connecting rod and the rear second connecting rod are pivotally connected to each other. The front first connecting rod is pivotally connected between the right connecting rod and the left diagonal strut. The front second connecting rod is pivotally connected between the left connecting rod and the right diagonal strut. The rear first connecting rod and the rear second connecting rod are pivotally connected between the left back rod and the right back rod.

With the above technical solutions, in the present invention, through the pair of armrest supporting rods pivotally connected between the upper left end of the front connecting frame unit and the front part of the left supporting frame unit and between the upper right end of the front connecting frame unit and the front part of the right supporting frame unit as well as the matching structure of the pair of armrest supporting rods and the pair of armrest rods, before a fat person seats himself/herself in the folding chair, the fat person can turn the armrest rods backward away from the armrest supporting rods. After the fat person seats himself/herself in the folding chair, the armrest rods are turned forward to align the armrest supporting rods. The armrest supporting rod is inserted in the accommodating chamber. The engaging plate is inserted in the receiving opening of the accommodating chamber, so that the spherical head of the armrest supporting rod passes through the through hole. Then, the engaging plate is engaged with the engaging groove, so as to realize the assembly and positioning of the armrest rod. It is convenient for a fat person to seat himself/herself in the folding chair. When the folding chair of the present invention is to be folded, the armrest rods are separated from the armrest supporting rods for the armrest rods to abut against the rear part of the left supporting frame unit and the rear part of the right supporting frame unit, thereby reducing the volume of the folding chair after being folded. When the folding chair of the present invention is unfolded for use, the armrest rods are secured and positioned by the armrest supporting rods and cannot be rotated, so that the folding chair of the present invention has strong stability.

DETAILED DESCRIPTION OF THE PREFERRED EMBODIMENTS

Embodiments of the present invention will now be described, by way of example only, with reference to the accompanying drawings.

Figure 1:
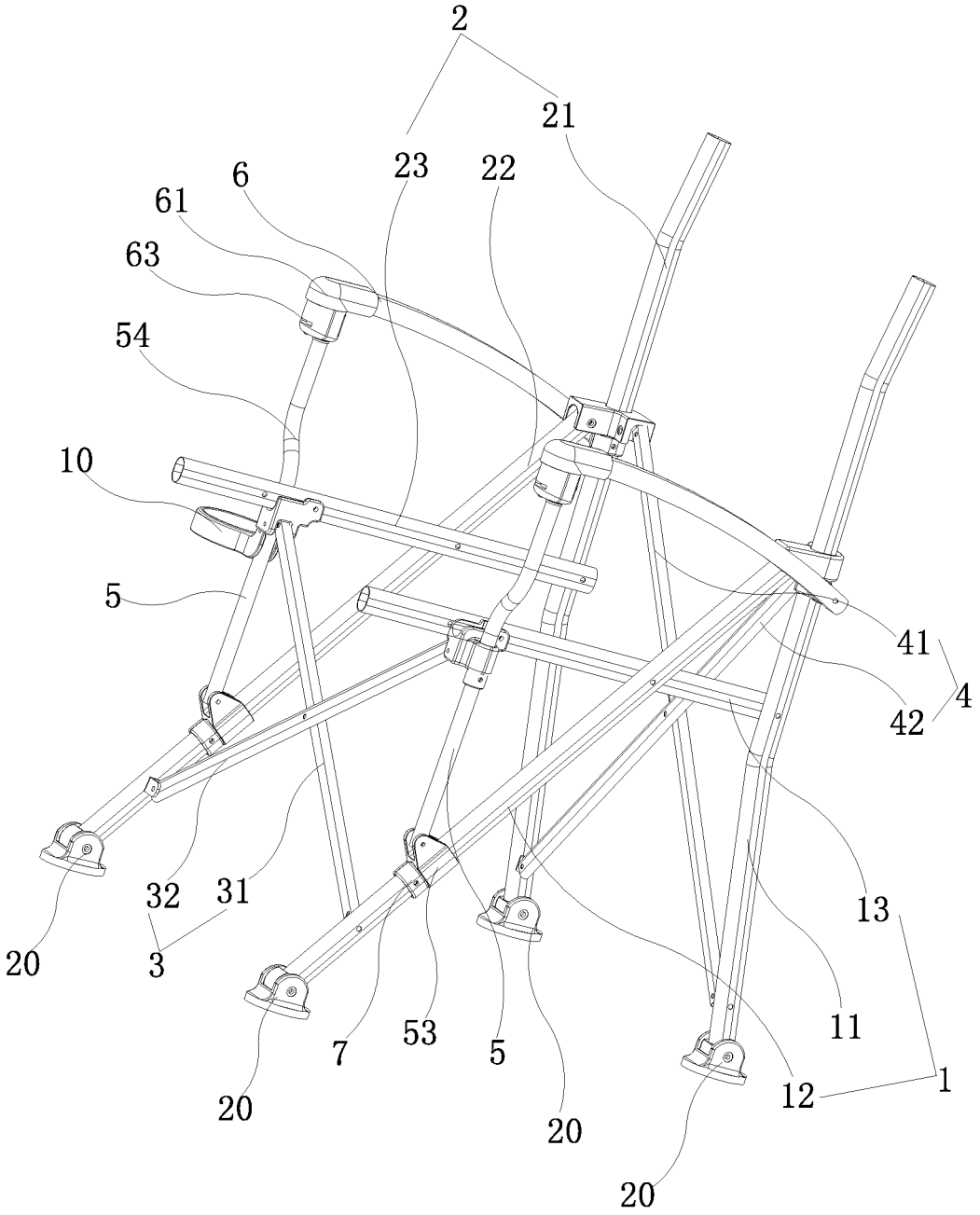
FIG. 1 is a first perspective view of the present invention when in use.
Figure 2:
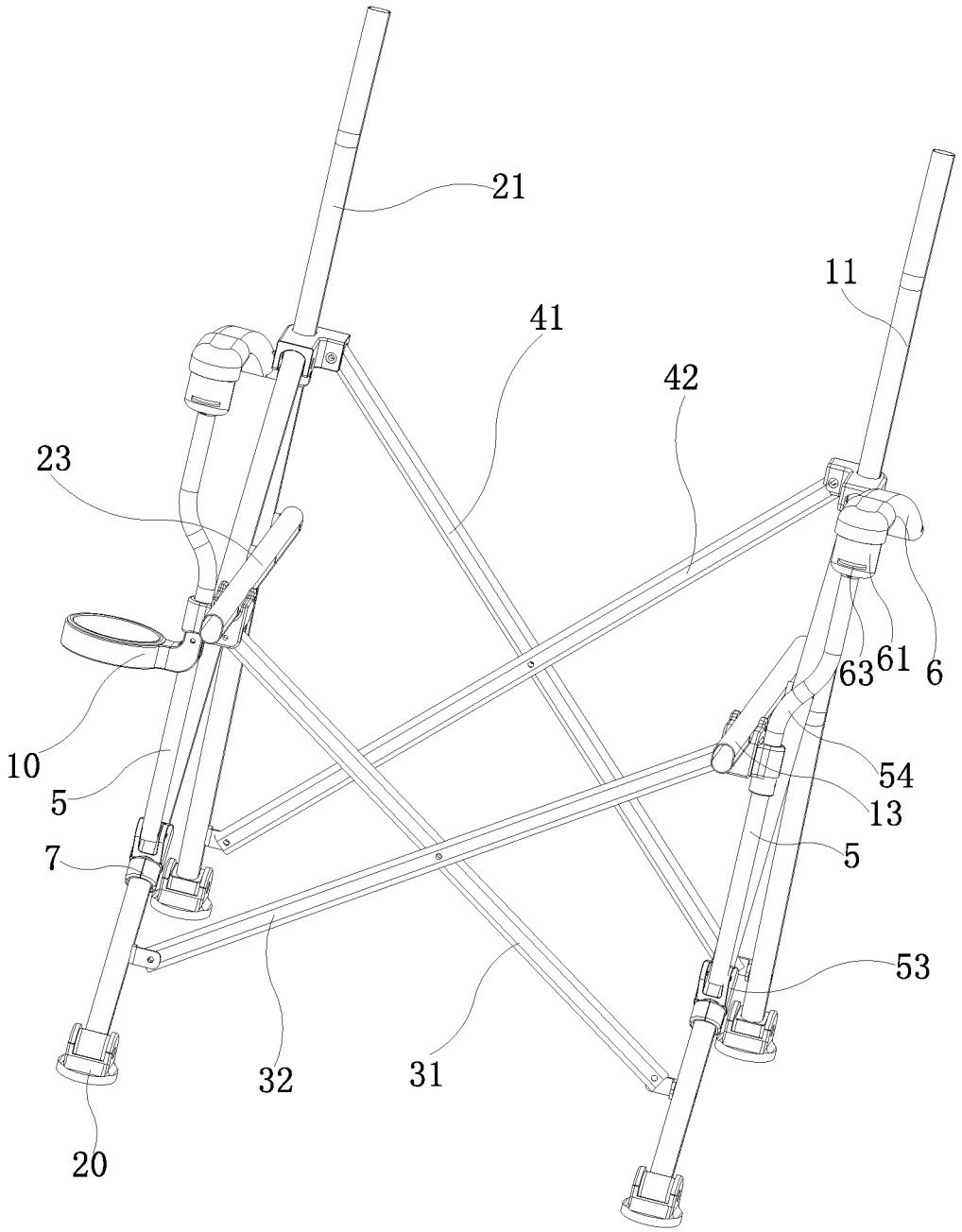
FIG. 2 is a second perspective view of the present invention when in use.
Figure 3:
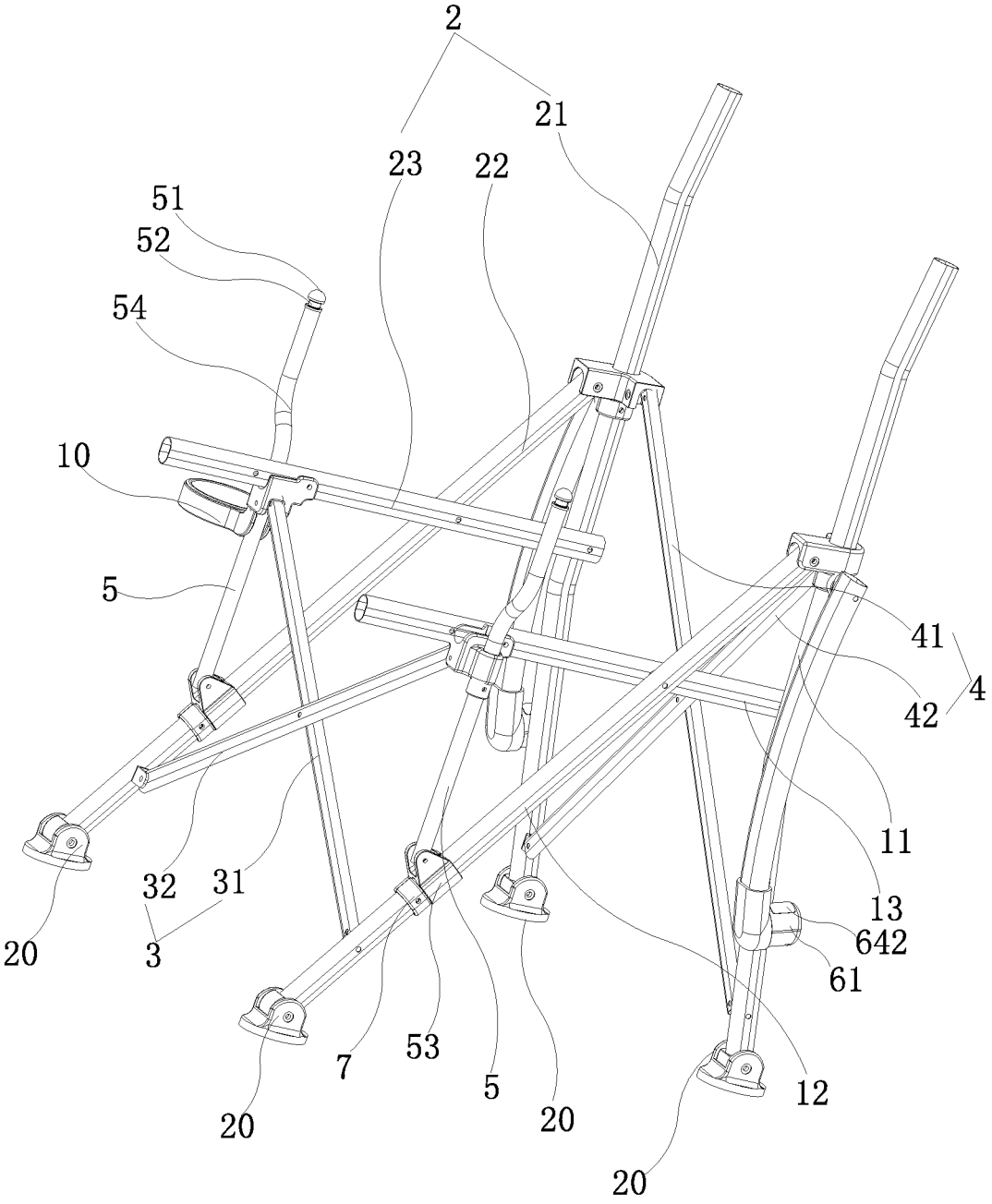
FIG. 3 is a perspective view of the present invention before the armrest rods are assembled and positioned.
Figure 4:
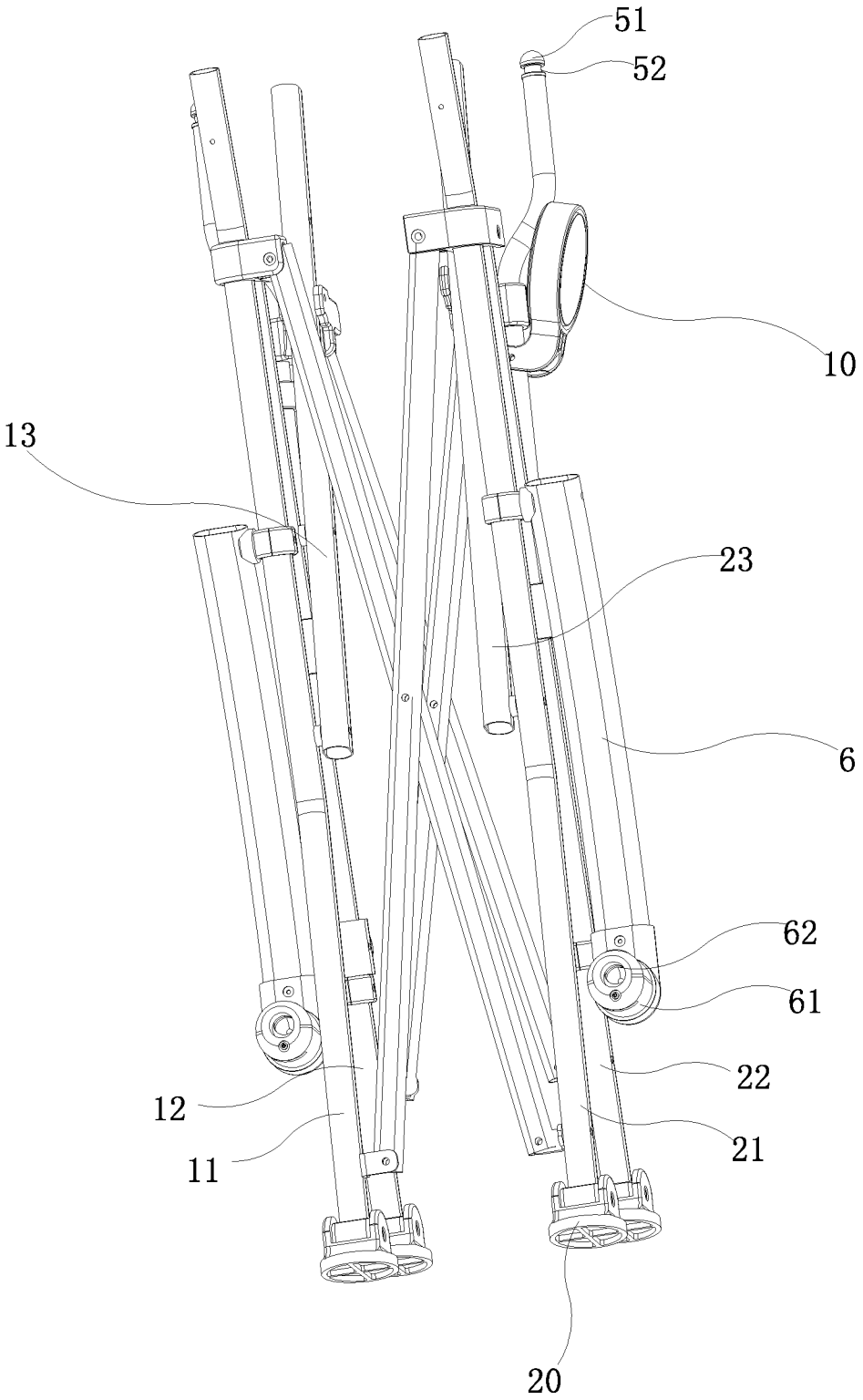
FIG. 4 is a perspective view of the present invention after being folded.
Figure 5:
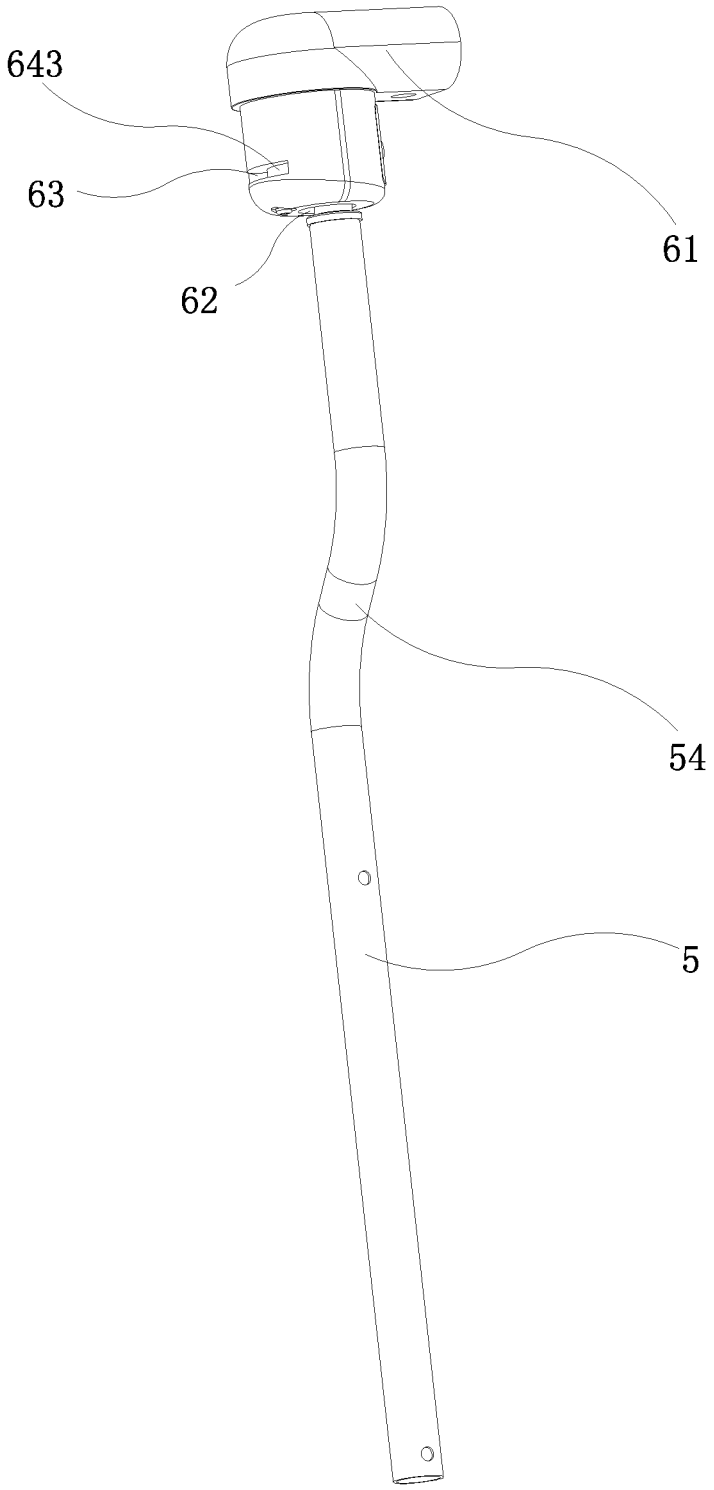
FIG. 5 is a perspective view showing the assembly of the armrest supporting rod and the joint of the armrest rod of the present invention.
Figure 6:
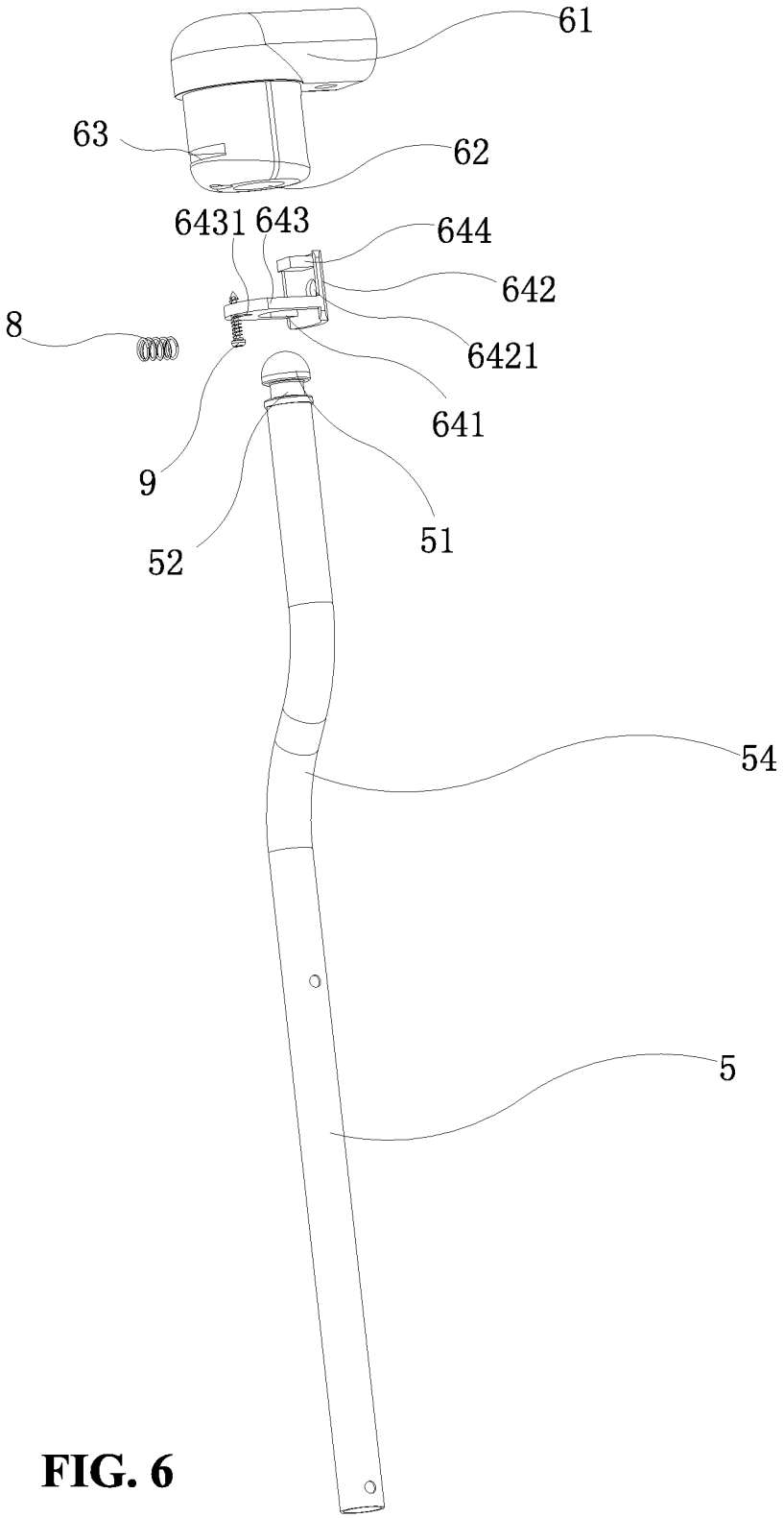
FIG. 6 is a first exploded view of FIG. 5.
Figure 7:
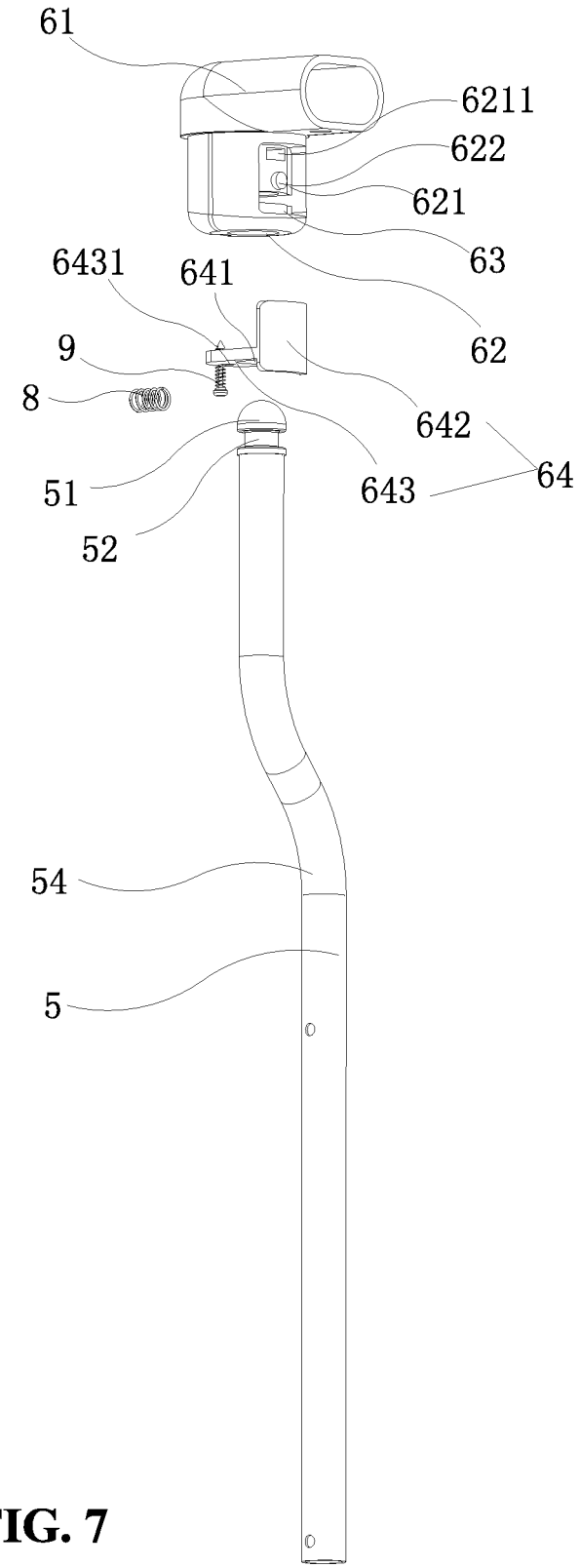
FIG. 7 is a second exploded view of FIG. 5.

Referring to FIG. 1 through FIG. 7, the present invention discloses a folding chair frame structure, comprising a left supporting frame unit 1, a right supporting frame unit 2, a front connecting frame unit 3, and a rear connecting frame unit 4. The front connecting frame unit 3 is pivotally connected between the front part of the left supporting frame unit 1 and the front part of the right supporting frame unit 2. The rear connecting frame unit 4 is pivotally connected between the rear part of the left supporting frame unit 1 and the rear part of the right supporting frame unit 2. A pair of armrest supporting rods 5 is pivotally connected between the upper left end of the front connecting frame unit 3 and the front part of the left supporting frame unit 1 and between the upper right end of the front connecting frame unit 3 and the front part of the right supporting frame unit 2, respectively. The top of the armrest supporting rod 5 has a spherical head 51. The armrest supporting rod 5 has an engaging groove 52 below the spherical head 51. A pair of armrest rods 6 is pivotally connected to the rear part of the left supporting frame unit 1 and the rear part of the right supporting frame unit 2. The front end of the armrest rod 6 has a joint 61. The lower end of the joint 61 has an accommodating chamber 62. The side wall of the accommodating chamber 62 has at least one receiving opening 63. An engaging plate 64 is detachably inserted in the receiving opening 63. The engaging plate 64 has a through hole 641. When the spherical head 51 is inserted in the accommodating chamber 62 and passes through the through hole 641, the engaging plate 64 is engaged with the engaging groove 52.

Thus, in the present invention, through the pair of armrest supporting rods 5 pivotally connected between the upper left end of the front connecting frame unit 3 and the front part of the left supporting frame unit 1 and between the upper right end of the front connecting frame unit 3 and the front part of the right supporting frame unit 2 as well as the matching structure of the pair of armrest supporting rods 5 and the pair of armrest rods 6, before a fat person seats himself/herself in the folding chair, the fat person can turn the armrest rods 6 backward away from the armrest supporting rods 5. After the fat person seats himself/herself in the folding chair, the armrest rods 6 are turned forward to align the armrest supporting rods 5. The armrest supporting rod 5 is inserted in the accommodating chamber 62. The engaging plate 64 is inserted in the receiving opening 63 of the accommodating chamber 62, so that the spherical head 51 of the armrest supporting rod 5 passes through the through hole 641. Then, the engaging plate 64 is engaged with the engaging groove 52, so as to realize the assembly and positioning of the armrest rod 6. It is convenient for a fat person to seat himself/herself in the folding chair. When the folding chair of the present invention is to be folded, the armrest rods 6 are separated from the armrest supporting rods 5 for the armrest rods 6 to abut against the rear part of the left supporting frame unit 1 and the rear part of the right supporting frame unit 2, thereby reducing the volume of the folding chair after being folded. When the folding chair of the present invention is unfolded for use, the armrest rods 6 are secured and positioned by the armrest supporting rods 5 and cannot be rotated, so that the folding chair of the present invention has strong stability.

Furthermore, in order to shorten the length of the armrest supporting rods 5 and facilitate the user's hands to rest on the armrest rods 6 of the present invention, a pair of slide sleeves 53 is connected to the bottoms of the armrest supporting rods 5. The slide sleeves 53 are sleeved on the front part of the left supporting frame unit 1 and the front part of the right supporting frame unit 2, respectively. A pair of restricting members 7 is disposed on the lower end of the front part of the left supporting frame unit 1 and the lower end of the front part of the right supporting frame unit 2. The slide sleeves 53 are located above the restricting members 7 and are slidable.

Furthermore, in order to prevent the engaging plate 64 from extending in the receiving opening 63 excessively and in order to pull the engaging plate 64 with ease, the engaging plate 64 includes a vertical plate 642 and a horizontal plate 643. The vertical plate 642 is vertically arranged at the end of the horizontal plate 643. The horizontal plate 643 has the through hole 641. When the horizontal plate 643 is inserted in the receiving opening 63 and the spherical head 51 passes through the through hole 641, the horizontal plate 643 is engaged with the engaging groove 52.

Furthermore, in order to improve the convenience and flexibility of the engaging plate 64, the outer side wall of the accommodating chamber 62 is recessed to form a plate groove 621 located above the receiving opening 63. The surface of the plate groove 621, facing the vertical plate 642, has a positioning post 622. The surface of the vertical plate 642, facing the plate groove 621, is recessed to form an accommodating hole 6421. A spring 8 is sleeved on the positioning post 622. The end of the spring 8 is accommodated in the accommodating hole 6421. The vertical plate 642 is disposed in the plate groove 621. When the vertical plate 642 is pressed, the spring 8 is compressed, so that the through hole 641 is aligned with the spherical head 51 for the spherical head 51 to pass through the through hole 641.

In order to restrict the engaging plate 64, the horizontal plate 643 is formed with a waist-shaped hole 6431. A locking member 9 is insertedly secured to the lower end of the joint 61. The locking member 9 passes through the waist-shaped hole 6431.

Furthermore, for the vertical plate 642 to be firmly mated with the plate groove 621, a mating plate 644 is vertically protruded from the surface of the vertical plate 642, facing the plate groove 621. The mating plate 644 is located above the accommodating hole 6421. The plate groove 621 is formed with a mating plate opening 6211. The mating plate 644 is movably inserted in the mating plate opening 6211.

Furthermore, in order to pull the engaging board 64 smoothly, the side wall of the accommodating chamber 62 is formed with two receiving openings 63. The receiving openings 63 are disposed opposite to each other. The horizontal plate 643 is connected between the receiving openings 63.

Furthermore, in order to facilitate the spherical head 61 to pass through the through hole 641 and the engaging plate 64 to be mated with the engaging groove 52, the through hole 641 has a front curved hole edge and a rear flat hole edge.

In addition, in order to improve the convenience of use, a cup holder 10 is pivotally connected to at least one of the pair of armrest supporting rods 5.

Furthermore, in order to facilitate a fat person to seat himself/herself in the folding chair of the present invention, the upper end of the armrest supporting rod 5 has a bent portion 54 that is bent outward.

In addition, in order to simplify the structure of the present invention, the left supporting frame unit 1 includes a left back rod 11, a left diagonal strut 12, and a left connecting rod 13. The top of the left diagonal strut 12 is pivotally connected to the left back rod 11. The left connecting rod 13 is pivotally connected among the left back rod 11, the left diagonal strut 12 and the adjacent armrest supporting rod 5. The right supporting frame unit 2 includes a right back rod 21, a right diagonal strut 22, and a right connecting rod 23. The top of the right diagonal strut 22 is pivotally connected to the right back rod 21. The right connecting rod 23 is pivotally connected among the right back rod 21, the right diagonal strut 22 and the adjacent armrest supporting rod 5. The front connecting frame unit 3 includes a front first connecting rod 31 and a front second connecting rod 32 that are intersected with each other. The middle portions of the front first connecting rod 31 and the front second connecting rod 32 are pivotally connected to each other. The rear connecting frame unit 4 includes a rear first connecting rod 41 and a rear second connecting rod 42 that are intersected with each other. The middle portions of the rear first connecting rod 41 and the rear second connecting rod 42 are pivotally connected to each other. The front first connecting rod 31 is pivotally connected between the right connecting rod 23 and the left diagonal strut 12. The front second connecting rod 32 is pivotally connected between the left connecting rod 13 and the right diagonal strut 22. The rear first connecting rod 41 and the rear second connecting rod 42 are pivotally connected between the left back rod 11 and the right back rod 21.

In order to facilitate the folding chair of the present invention to stand stably, foot support seats 20 are pivotally connected to the bottom of the left back rod 11, the bottom of the left diagonal strut 12, the bottom of the right back rod 21 and the bottom of the right diagonal strut 22, respectively.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A folding chair frame structure, comprising a left supporting frame unit, a right supporting frame unit, a front connecting frame unit and a rear connecting frame unit, the front connecting frame unit being pivotally connected between a front part of the left supporting frame unit and a front part of the right supporting frame unit, the rear connecting frame unit being pivotally connected between a rear part of the left supporting frame unit and a rear part of the right supporting frame unit, a pair of armrest supporting rods being pivotally connected between an upper left end of the front connecting frame unit and the front part of the left supporting frame unit and between an upper right end of the front connecting frame unit and the front part of the right supporting frame unit respectively, a top of each armrest supporting rod having a spherical head, each armrest supporting rod having an engaging groove below the spherical head, a pair of armrest rods being pivotally connected to a rear part of the left supporting frame unit and a rear part of the right supporting frame unit, a front end of each armrest rod having a joint, a lower end of the joint having an accommodating chamber, a side wall of the accommodating chamber having at least one receiving opening, an engaging plate being detachably inserted in the receiving opening, the engaging plate having a through hole, wherein when the spherical head is inserted in the accommodating chamber and passes through the through hole, the engaging plate is engaged with the engaging groove.

2. The folding chair frame structure as claimed in claim 1, wherein the engaging plate includes a vertical plate and a horizontal plate, the vertical plate is vertically arranged at one end of the horizontal plate, the horizontal plate has the through hole, when the horizontal plate is inserted in the receiving opening and the spherical head passes through the through hole, the horizontal plate is engaged with the engaging groove.

3. The folding chair frame structure as claimed in claim 2, wherein an outer side wall of the accommodating chamber is recessed to form a plate groove located above the receiving opening, a surface of the plate groove, facing the vertical plate, has a positioning post, a surface of the vertical plate, facing the plate groove, is recessed to form an accommodating hole, a spring is sleeved on the positioning post, one end of the spring is accommodated in the accommodating hole, the vertical plate is disposed in the plate groove, when the vertical plate is pressed, the spring is compressed, so that the through hole is aligned with the spherical head for the spherical head to pass through the through hole.

4. The folding chair frame structure as claimed in claim 3, wherein the horizontal plate is formed with a waist-shaped hole, a locking member is insertedly secured to the lower end of the joint, and the locking member passes through the waist-shaped hole.

5. The folding chair frame structure as claimed in claim 3, wherein a mating plate is vertically protruded from the surface of the vertical plate, facing the plate groove, the mating plate is located above the accommodating hole, the plate groove is formed with a mating plate opening, and the mating plate is movably inserted in the mating plate opening.

6. The folding chair frame structure as claimed in claim 2, wherein the at least one receiving opening includes two receiving openings, the receiving openings are disposed opposite to each other, and the horizontal plate is connected between the receiving openings.

7. The folding chair frame structure as claimed in claim 1, wherein the through hole has a front curved hole edge and a rear flat hole edge.

8. The folding chair frame structure as claimed in claim 1, wherein a cup holder is pivotally connected to at least one of the pair of armrest supporting rods, a pair of slide sleeves is connected to respective bottoms of the armrest supporting rods, the slide sleeves are sleeved on the front part of the left supporting frame unit and the front part of the right supporting frame unit respectively, a pair of restricting members is disposed on a lower end of the front part of the left supporting frame unit and a lower end of the front part of the right supporting frame unit, and the slide sleeves are located above the restricting members and are slidable.

9. The folding chair frame structure as claimed in claim 1, wherein an upper end of each armrest supporting rod has a bent portion that is bent outward.

10. The folding chair frame structure as claimed in claim 1, wherein the left supporting frame unit includes a left back rod, a left diagonal strut and a left connecting rod, a top of the left diagonal strut is pivotally connected to the left back rod, the left connecting rod is pivotally connected among the left back rod, the left diagonal strut and an adjacent one of the pair of armrest supporting rods, the right supporting frame unit includes a right back rod, a right diagonal strut and a right connecting rod, a top of the right diagonal strut is pivotally connected to the right back rod, the right connecting rod is pivotally connected among the right back rod, the right diagonal strut and an adjacent one of the pair of armrest supporting rods, the front connecting frame unit includes a front first connecting rod and a front second connecting rod that are intersected with each other, middle portions of the front first connecting rod and the front second connecting rod are pivotally connected to each other, the rear connecting frame unit includes a rear first connecting rod and a rear second connecting rod that are intersected with each other, middle portions of the rear first connecting rod and the rear second connecting rod are pivotally connected to each other, the front first connecting rod is pivotally connected between the right connecting rod and the left diagonal strut, the front second connecting rod is pivotally connected between the left connecting rod and the right diagonal strut, the rear first connecting rod and the rear second connecting rod are pivotally connected between the left back rod and the right back rod.

* * * * *